US009956473B2

(12) United States Patent
Chiu

(10) Patent No.: US 9,956,473 B2
(45) Date of Patent: May 1, 2018

(54) TRANSPORTATION VEHICLE

(71) Applicant: Kevin Chiu, Taipei (TW)

(72) Inventor: Kevin Chiu, Taipei (TW)

( * ) Notice: Subject to any disclaimer, the term of this patent is extended or adjusted under 35 U.S.C. 154(b) by 0 days. days.

(21) Appl. No.: 14/744,203

(22) Filed: Jun. 19, 2015

(65) Prior Publication Data

US 2016/0367884 A1 Dec. 22, 2016

(51) Int. Cl.

*A63C 17/12* (2006.01)
*A63C 17/00* (2006.01)
*A63C 17/01* (2006.01)

(52) U.S. Cl.

CPC ..... *A63C 17/12* (2013.01); *A63C 17/0033* (2013.01); *A63C 17/015* (2013.01); *A63C 2203/10* (2013.01); *A63C 2203/12* (2013.01)

(58) Field of Classification Search

CPC .... A63C 17/0033; A63C 17/015; A63C 17/12
See application file for complete search history.

(56) References Cited

U.S. PATENT DOCUMENTS 6,050,357 A * 4/2000 Staelin ..... A63C 17/004 180/181
6,089,341 A * 7/2000 Gingerich ..... B60L 8/00 180/2.2
9,095,766 B1 * 8/2015 Christie ..... A63C 17/01
2009/0000839 A1 * 1/2009 Ishii ..... A01D 34/64 180/65.51
2009/0228166 A1 * 9/2009 Durkos ..... G05D 1/0246 701/26
2015/0008058 A1 1/2015 Sato et al.
(Continued)

FOREIGN PATENT DOCUMENTS

CN 104117199 10/2014

OTHER PUBLICATIONS

Office Action for Taiwan Patent Application No. TW 105118821, dated Mar. 24, 2017, 6 Pages. (With English Translation of Search Report).

*Primary Examiner* — Joseph M Rocca
*Assistant Examiner* — Felicia L. Brittman
(74) *Attorney, Agent, or Firm* — Fenwick & West LLP

(57) ABSTRACT

A personal transportation vehicle comprises a carrier, a control device, a first pair of wheels and a second pair of wheels, wherein the first pair of wheels are fixed in a direction and the second pair of wheels are mounted on swivels disposed below the carrier, each of the first pair of wheels and the second pair of wheels comprises a first wheel and a second wheel, and the first pair of wheels and the second pair of wheels are arranged aligned and parallel to each other below the carrier, a first controller, a first driving device for driving the first wheel of the first pair of wheels, a second controller and a second driving device for driving the second wheel of the first pair of wheels. The control device is configured to transmit signals to the first controller and the second controller to control the first driving device and the second driving device, such that the second pair of wheels are swiveled and driven by a difference between the rotational speeds of the first wheel and the second wheel of the first pair of wheels to determine a movement direction of the transportation vehicle.

16 Claims, 6 Drawing Sheets

(56) References Cited

U.S. PATENT DOCUMENTS

| | | | | |
|---|---|---|---|---|
| 2016/0050847 | A1* | 2/2016 | Bartel | A01D 34/64<br>56/15.2 |
| 2016/0114242 | A1* | 4/2016 | Riley | A63C 17/015<br>180/233 |

* cited by examiner

TRANSPORTATION VEHICLE

BACKGROUND

1. Technical Field

The present invention generally relates to transportation vehicles; specifically, to a personal transportation vehicle.

2. Description of the Related Art

There are many forms of transportation vehicles (such as, automobiles, motorcycles, etc.,) for carrying users or goods to a destination. Due to environmental and fuel requirement issues, personal transportation vehicles are rising in popularity. One simple type of personal transportation vehicle is a skateboard. A skateboard comprises a board and two pairs of wheels mounted below the board. The user stands on the board and uses one of his/her legs to propel the skateboard. Another type of personal transportation vehicle is a two-wheel kick scooter. A two-wheel kick scooter comprises a board, a handlebar installed on the board, and front and rear wheels mounted below the board, wherein the handlebar is connected to the front wheel for steering the two-wheel kick scooter. The user stands on the board with his/her hands holding the handlebar, and uses his/her legs to propel the kick scooter.

SUMMARY

The present disclosure provides a type of transportation vehicle that is compact, light-weight and user-friendly. Additionally, the transportation vehicle is powered by electricity, which is quieter in operation and causes less air pollution than the vehicles powered by gasoline. Thus, the user can ride the personal transportation vehicle comfortably and smoothly.

According to an embodiment of the present disclosure, the transportation vehicle comprises: a carrier; a first pair of wheels and a second pair of wheels, wherein the first pair of wheels are fixed in a direction and the second pair of wheels are mounted on swivels, each pair of wheels comprises a first wheel and a second wheel, and the first and second pairs of wheels are arranged in parallel to each other below the carrier; a first driving device for driving the first wheel of the first pair of wheels, a second driving device for driving the second wheel of the first pair of wheels; and a control device that is configured to transmit signals to the first driving device and the second driving device, so as to drive the first pair of wheels, such that the second pair of wheels are swiveled and driven by a difference between the rotational speeds of the first wheel and the second wheel of the first pair of wheels to determine a movement direction of the transportation vehicle.

According to another embodiment of the present disclosure, a transportation vehicle, comprising: a carrier and a mechanical part; the carrier having a first edge and a second edge; the mechanical part comprising: a pair of driving wheels arranged at the mechanical part and proximal to the first edge, the pair of driving wheels including a first driving wheel and a second driving wheel, the first and second driving wheels being fixed in a direction; a pair of driven wheels mounted on swivels arranged at the mechanical part and being proximal to the second edge, the pair of driven wheels being parallel to the pair of driving wheels; a first driving device having a first motor for driving the first driving wheel; a first controller connected to the first driving device for controlling the first driving device; a second driving device having a second motor for driving the second driving wheel; a second controller connected to the second driving device for controlling the second driving device; a control device configured to communicate with the first controller and the second controller to control the first driving device and the second driving device; and a power device coupled to the first driving device and the second driving device.

The transportation vehicle of the present invention comprises four wheels. Additionally, the first pair of wheels are arranged closer to a rear of the carrier than the second pair of wheels, and the second pair of wheels are driven and swiveled by the first pair of wheels. Thus, the user can easily and stably ride on the transportation vehicle. Furthermore, the transportation vehicle does not need a steering device, as a result of the structure and operating method of the present invention. Accordingly, the transportation vehicle will be light and compact.

DETAILED DESCRIPTION

As used herein, relative terms, such as "top," "bottom," "front," "rear," "upper," "lower," "above," and "below," refer to an orientation of a set of components with respect to one another; this orientation of the components is in accordance with the drawings, but is not required during manufacturing or use.

As used herein, the terms "connect," "connected," and "connection" refer to an operational coupling or linking. Connected components can be directly or indirectly coupled to one another, for example, through another set of components.

Additionally, amounts, ratios, and other numerical values are sometimes presented herein in a range format. It is understood that such range formats are used for convenience and brevity, and should be interpreted flexibly to include numerical values explicitly specified as limits of a range, as well as all individual numerical values or sub-ranges encompassed within that range, as if each numerical value and sub-range is explicitly specified.

Figure 1:
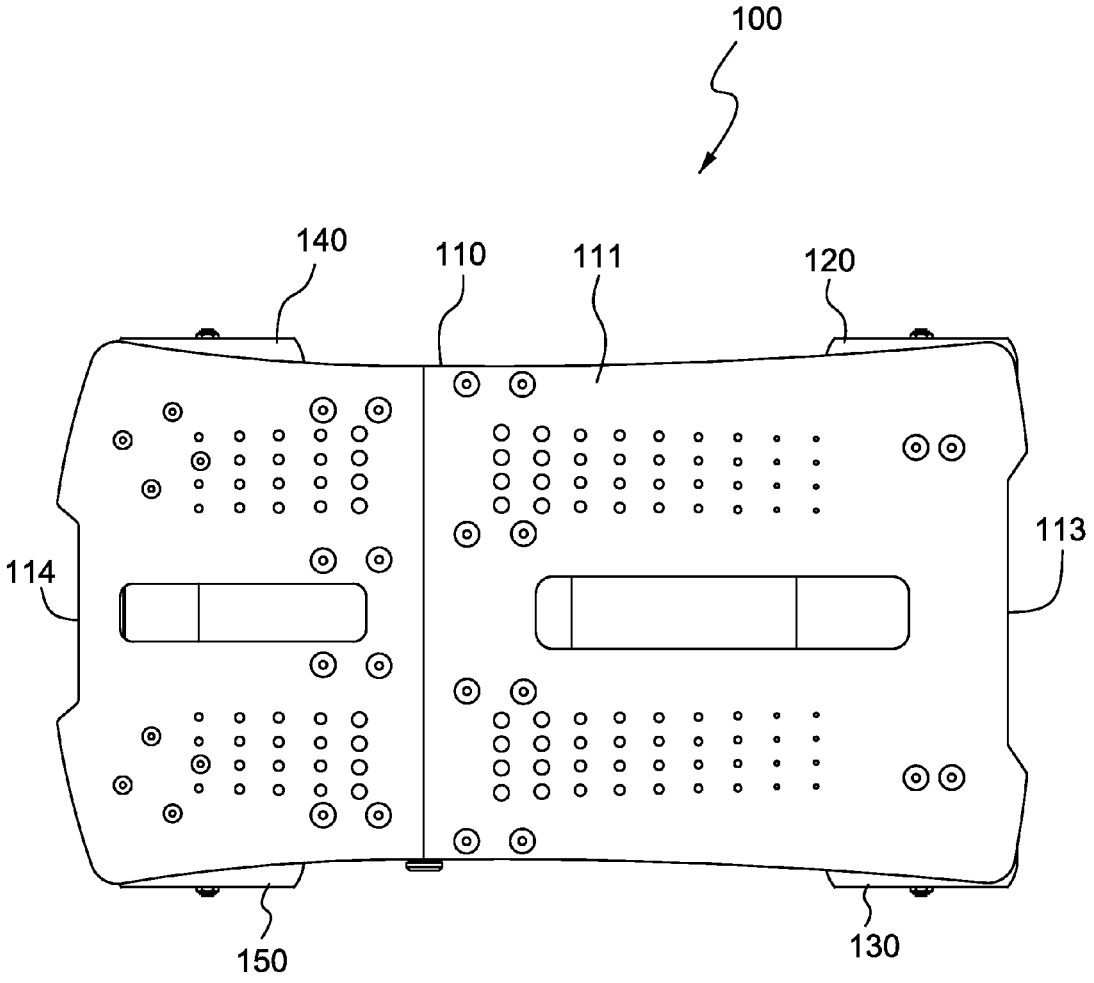
FIG. 1 is a top view of a transportation vehicle according to one embodiment of the present invention.
Figure 2:
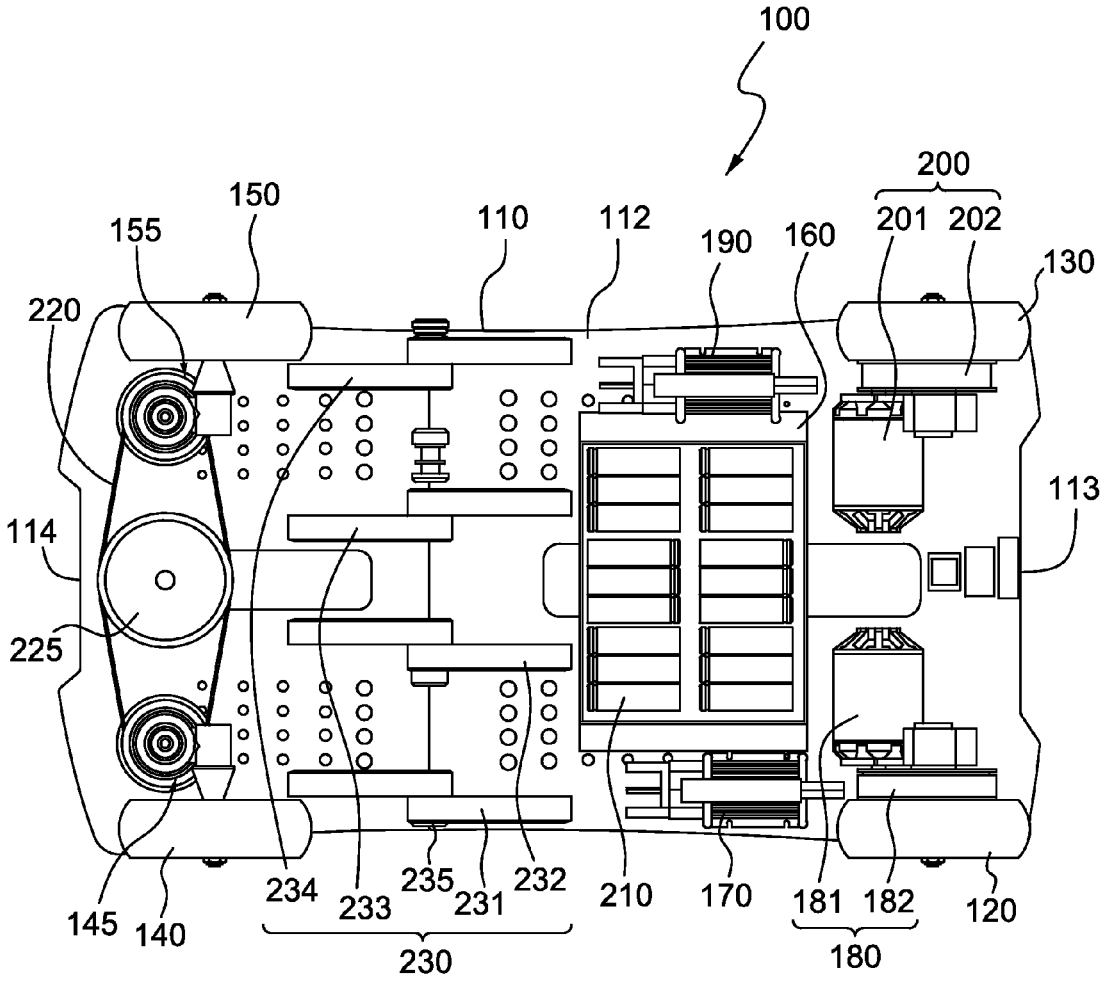
FIG. 2 is a bottom view of a transportation vehicle according to one embodiment of the present invention.
Figure 3:
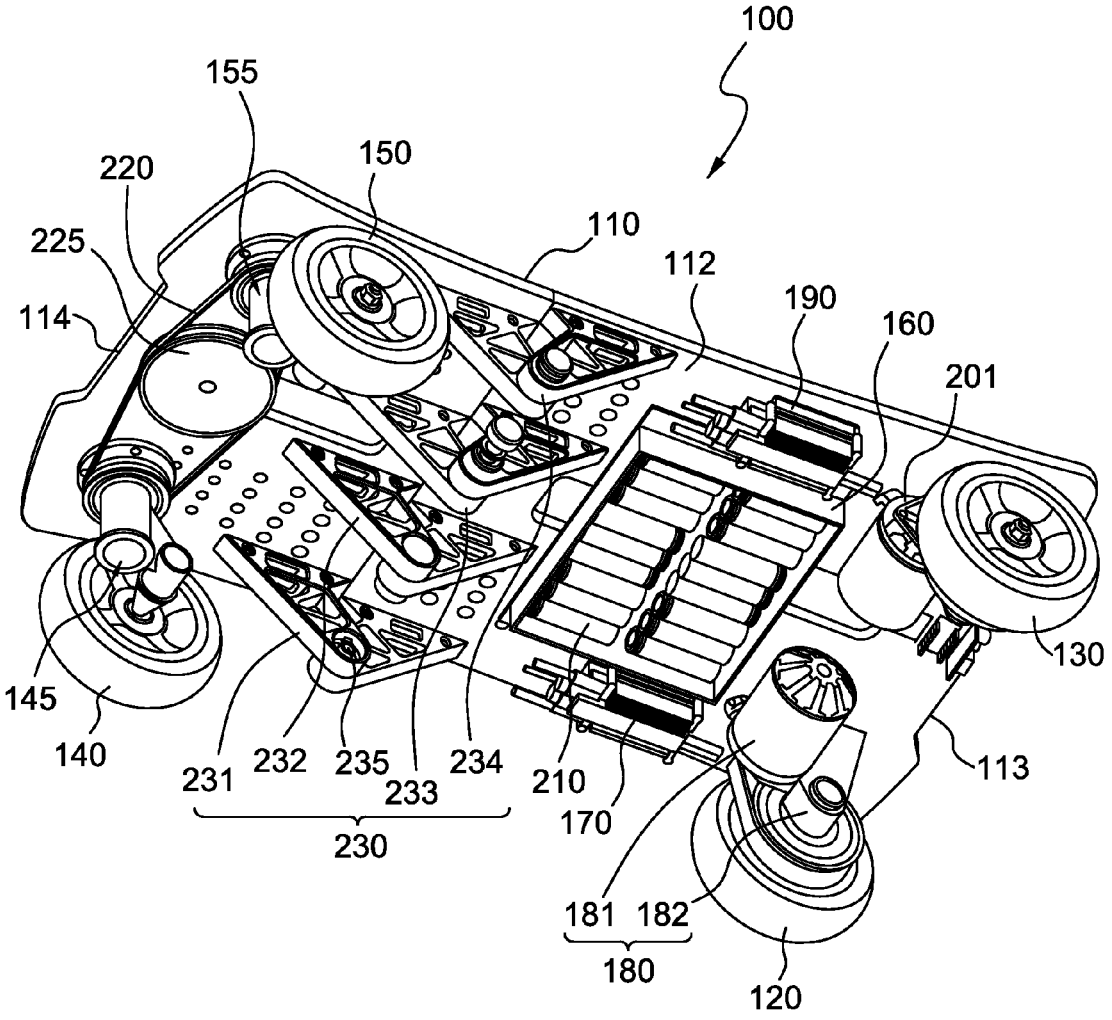
FIG. 3 is a bottom three-dimensional view of a transportation vehicle according to one embodiment of the present invention.

FIG. 1 illustrates a top view of a transportation vehicle according to one embodiment of the present invention. FIG. 2 illustrates a bottom view of the transportation vehicle 100, and FIG. 3 illustrates a bottom three-dimensional view of the transportation vehicle 100. In an embodiment, the transportation vehicle 100 comprises a carrier 110, a first pair of wheels 120, 130, a pair of swivels 145, 155, and a second pair of wheels 140, 150. The first pair of wheels 120, 130 and the second pair of wheels 140, 150 are arranged in parallel below the carrier 110. The first pair of wheels 120, 130 are fixed in a direction and the second pair of wheels 140, 150 are mounted on respective swivels 145, 155 below the carrier 110. The transportation vehicle 100 further comprises a control device 160 that is configured to transmit signals to a first driving device 180 for driving the first wheel 120 and to a second driving device 200 for driving the second wheel 130. In the case that the rotational speeds of the first wheel 120 and second wheel 130 are the same, the second pair of wheels 140, 150 will not turn but will be driven in the same direction as the first pair of wheels 120, 130, and the movement direction of transportation vehicle 100 will be in a forward/backward line. In the case that the rotational speeds of the first wheel 120 and second wheel 130 are different, the second pair of wheels 140, 150 will be swiveled and driven by a difference between the rotational speeds of the first wheel 120 and the second wheel 130, and the transportation vehicle 100 turns in the movement direction.

In an embodiment, the control device 160 of the transportation vehicle 100 may further comprise a first controller 170 and a second controller 190. Then, the first controller 170 and the second controller 190 respectively transmit signals to control the first and second driving devices 180, 200.

In an embodiment, the first pair of wheels 120, 130 is closer to the rear of the carrier than the second pair of wheels 140, 150. Furthermore, the second pair of wheels 140, 150 are swiveled and driven by the first pair of wheels 120, 130, i.e., the second pair of wheels 140, 150 do not have their own driving force. This arrangement can prevent the transportation vehicle from overturning when the emergency brakes are engaged or the transportation vehicle enters rugged terrain. When the transportation vehicle moves forward, if the rotational speed of the first wheel 120 is less than the rotational speed of the second wheel 130, the second pair of wheels 140, 150 will turn right, so that the transportation vehicle 100 turns right; if the rotational speed of the first wheel 120 is greater than the rotational speed of the second wheel 130, the second pair of wheels 140, 150 will turn left, so that the transportation vehicle 100 turns left. Therefore, the transportation vehicle 100 does not need a steering device, which is usually bulky and/or heavy. Accordingly, the transportation vehicle 100 can be compact and lightweight, and the user can ride the transportation vehicle 100 smoother, more stable and safer.

In an embodiment, the transportation vehicle 100 includes a carrier 110 having a carrier part 111 and a mechanical part 112. The carrier 110 comprises a first edge 113 and a second edge 114. The first pair of wheels 120, 130 of the mechanical part 112 are composed of a pair of driving wheels and proximal the first edge 113, and the second pair of wheels 140, 150 are mounted on a pair of swivels 145, 155 disposed below the mechanical part 112, parallel to the first pair of wheels and proximal the second edge 114. The user can stand on the carrier part 111 of the carrier 110 to ride the transportation vehicle 100. The mechanical part 112 further comprises a first driving device 180 having a first motor 181 for driving the first driving wheel 120, and a second driving device 200 having a second motor 201 for driving the second driving wheel 130. The mechanical part 112 further comprises the control device 160 configured to communicate with the first controller 170 and the second controller 190 to control the first driving device 180 and the second driving device 200, so as to determine the rotational speeds of the first pair of driving wheels 120, 130. A power device 210 in the mechanical part 112 is coupled to the first driving device 180 and the second driving device 200 to supply power. In one embodiment, the first edge 113 is the rear edge, and the second edge 114 is the front edge.

For the purpose of weight reduction, the materials used to construct the transportation vehicle 100 comprise at least one of the following group, consisting of: a light-weight composite material and carbon fiber material. Additionally, the first pair of wheels 120, 130 and the second pair of wheels 140, 150 are pneumatic tires.

The carrier 110 can be a rectangle. For example, the carrier 110 has a length of about 45-70 cm and a width of about 30-50 cm, so that the user will be able to stand firmly on the carrier part 111 of the carrier 110. These dimensions were chosen to accommodate the average user. The transportation vehicle 100 can also be used to carry goods or objects. Therefore, the carrier 110 can be an ellipse, a polygon or other shape, depending on situational design needs.

Further referring to FIG. 2, the first wheel 120 of the first pair of wheels is driven by a first driving device 180, and the second wheel 130 of the first pair of wheels is driven by a second driving device 200. The first driving device 180 has a first motor 181, and the second driving device 200 has a second motor 201. Each of the first motor 181 and the second motor 201 can be a brushless motor, a hob motor or an explicit motor.

The first driving device 180 and the second driving device 200 can be powered by a power device 210. The power device 210 is mounted on the mechanical part 112. The power device 210 can be a battery or a battery pack.

The first driving device 180 may further comprise a first reduction gear 182, and the second driving device 200 may further comprise a second reduction gear 202. This arrangement would effectively increase the torsion force of the mechanical part 112, and facilitate the transportation vehicle's ability to move up a slope.

In an embodiment, the second pair of wheels 140, 150 are parallel to each other, and the swivels 145, 155 are coupled by a linkage structure 220 so that the second pair of wheels 140, 150 will move in the same direction. The linkage structure 220 may comprise a belt, a shaft, an axle or a chain. As shown in FIG. 2, the linkage structure 220 is a belt. Additionally, the linkage structure 220 may further comprise an expander 225. The expander 225 is to stretch the belt, so that the second pair of swivels 145, 155 are connected by the belt tightly. When the transportation vehicle 100 is in operation, the second pair of wheels 140, 150 are swiveled consistently and synchronously.

Figure 4:
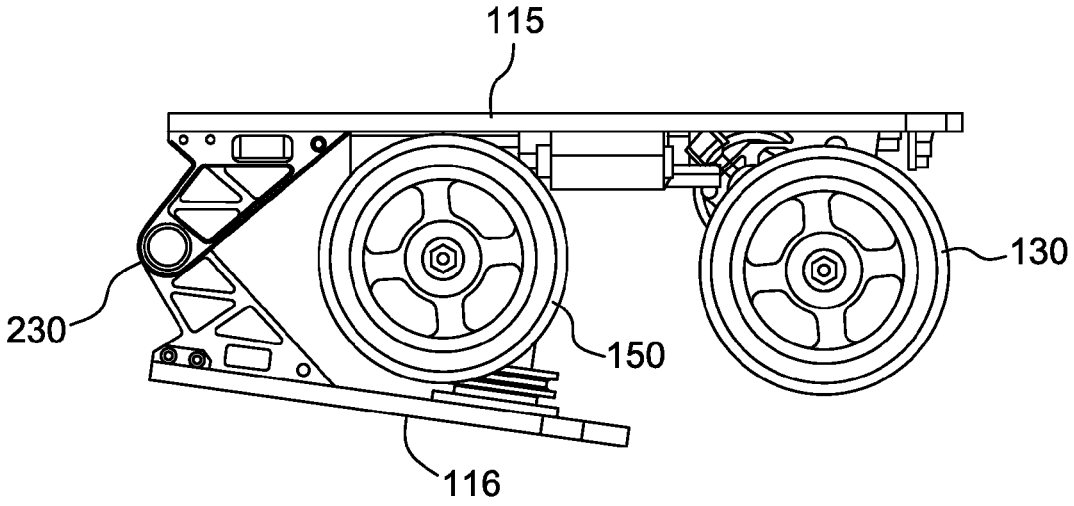
FIG. 4 is a side view of a transportation vehicle in a folded state according to one embodiment of the present invention.
Figure 5:
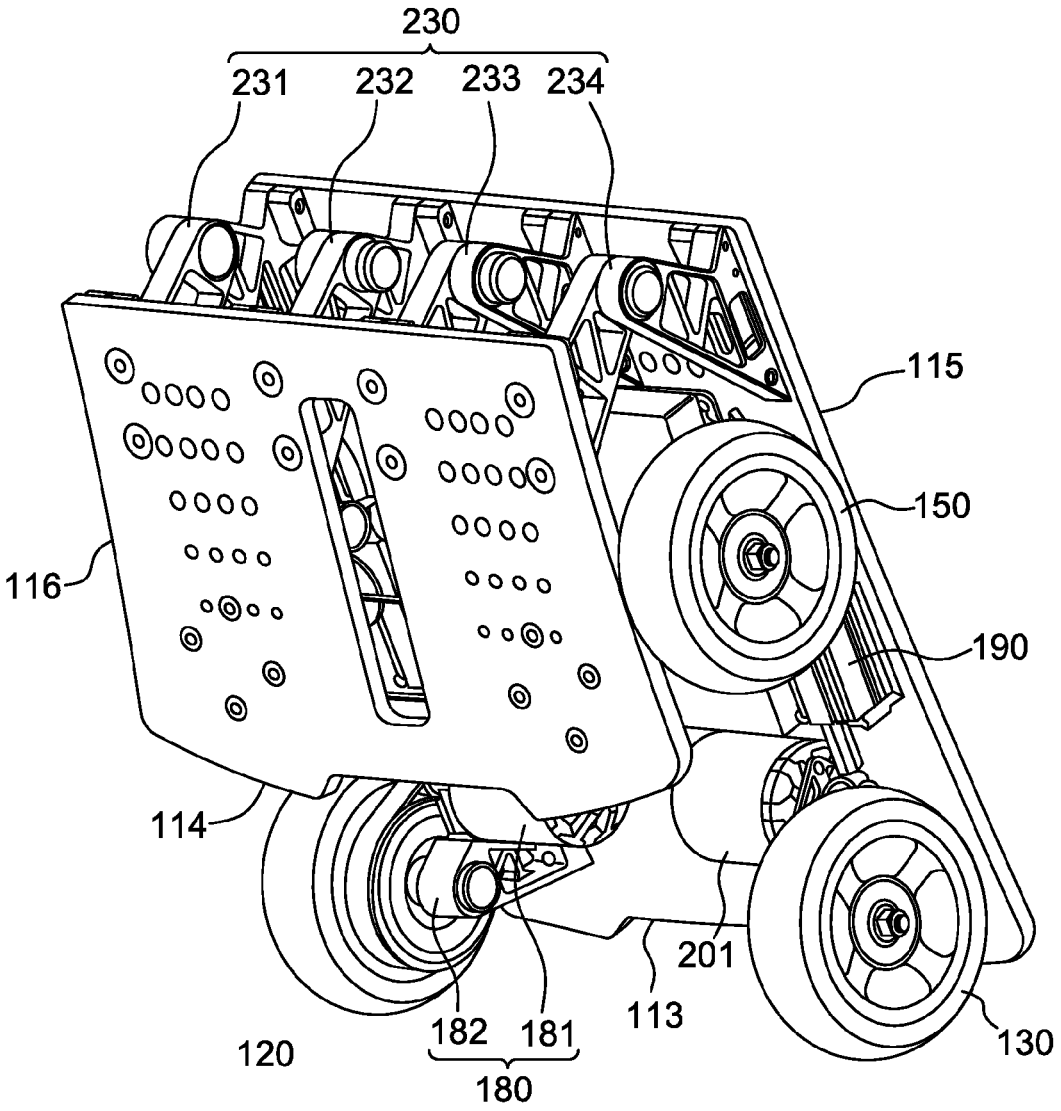
FIG. 5 is a three-dimensional view of a transportation vehicle in a folded state according to one embodiment of the present invention.

FIG. 4 illustrates a side view of a transportation vehicle in a folded state according to one embodiment of the present invention, and FIG. 5 is a three-dimensional diagram of a transportation vehicle in a folded state according to one embodiment of the present invention. As shown in FIGS. 4 and 5, the transportation vehicle 100 is foldable. The carrier 110 comprises a first portion 115 and a second portion 116. The first portion 115 and the second portion 116 are connected by a connecting structure 230. The connecting structure 230 may be arranged close to both sides of the carrier 110. The connecting structure 230 may comprise multiple connecting devices 231, 232, 233, 234. When folding the transportation vehicle 100, the carrier 110 is folded at the joint of the first portion 115 and the second portion 116, so that the first pair of wheels 120, 130 and the second pair of wheels 140, 150 move toward each other. The connecting structure 230 may further comprise a lock mechanism 235, which locks and/or unlocks the first portion 115 and the second portion 116 in a folding position or in an operating position.

Figure 6:
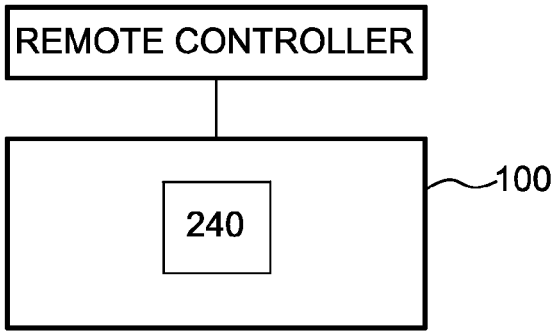
FIG. 6 illustrates a schematic diagram of a transportation vehicle comprising a weight sensor according to one embodiment of the present invention.

FIG. 6 illustrates a schematic diagram of a transportation vehicle according to one embodiment of the present invention. The control device of the transportation vehicle 100 can wirelessly communicate with a remote controller. The remote controller can be a portable device held by the user. The remote controller may be a mobile phone or a tablet computer.

In an embodiment, the transportation vehicle 100 may further comprise a weight sensor 240 to sense the weight loaded on the carrier 110. The weight sensor can be installed on the carrier 110. For safety reasons, if the user gets off the transportation vehicle 100, and once the weight sensor senses no weight on the carrier 110, the control device receives signals indicating that the carrier 110 is empty, and transmits signals to the first driving device 180 and the second driving device 200 to stop the first pair of wheels 120, 130, so as to stop the transportation vehicle 100.

Figure 7:
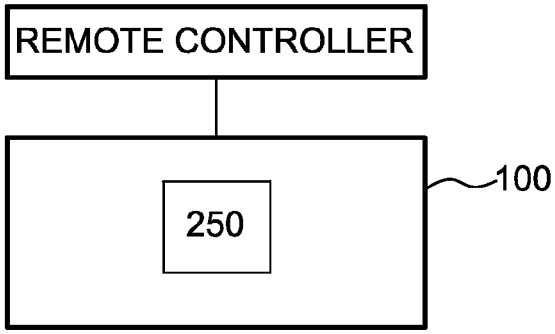
FIG. 7 illustrates a schematic diagram of a transportation vehicle comprising a pressure sensor according to one embodiment of the present invention.

FIG. 7 illustrates a schematic diagram of a transportation vehicle comprising a pressure sensor according to one embodiment of the present invention. The transportation vehicle 100 may comprise a pressure sensor 250 to sense the pressure distribution on the carrier 110, so as to control the transportation vehicle 100. The pressure sensor 250 can be installed on the carrier 110. For example, the user stands on the carrier 110 to drive the transportation vehicle 100. When the user wishes to make a right turn, the user can move his/her center of gravity to the right portion of the carrier 110, and the pressure sensor 250 will sense the pressure on the right portion of the carrier 110. The control device receives the signals from the pressure sensor 250 and transmits signals to the first driving device 180 and the second driving device 200, so as to make the transportation vehicle 100 turn right. Similarly, when the user moves his/her center of gravity to the front portion of the carrier 110, the control device will speed up the movement of the transportation vehicle 100, and vice versa.

Figure 8:
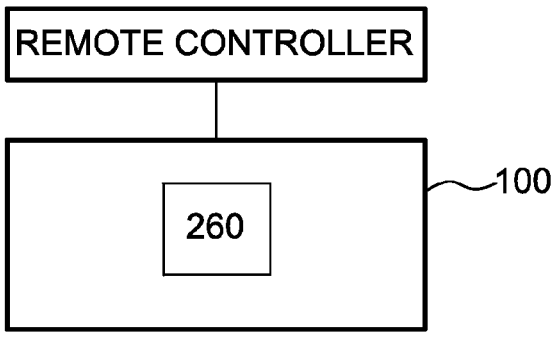
FIG. 8 illustrates a schematic diagram of a transportation vehicle comprising a global positioning system (GPS) according to one embodiment of the present invention.

FIG. 8 illustrates a schematic diagram of a transportation vehicle comprising a global positioning system (GPS) according to one embodiment of the present invention. The transportation vehicle 100 may comprise a GPS device 260 to allow remote operation. A remote controller, such as a computer in a transport control center, can design a route for carrying the user/goods to a destination. The remote controller can transmit signals to the GPS device 260 of the transportation vehicle 100 so as to communicate with the control device 160 to control the first driving device 180 and the second driving device 200, and then remotely drive the transportation vehicle 100 to follow a route. In this manner, the transportation vehicle 100 can be an auto-driving transportation vehicle 100.

According to one embodiment of the present invention, the transportation vehicle 100 functions to support and carry a user/goods. According to another aspect of the present invention, the transportation vehicle 100 further comprises a handlebar (not shown). The handlebar can be mounted at the second portion 116 (such as the front portion) of the carrier 110. The user could then hold the handlebar when riding the transportation vehicle 100. Additionally, according to another aspect of the present invention, the transportation vehicle 100 further comprises a seat (not shown), which is mounted at the first portion 115 (such as the rear portion) of the carrier 110. The user could then sit on the seat when riding the transportation vehicle 100. The handlebar 610 and the seat both provide the user with a better way of riding the transportation vehicle 100. The transportation vehicle 100 may comprise a safety system such as a system that detects nearby sounds and possible barriers. This arrangement can facilitate the transportation vehicle 100 automatically moving along the designated path.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims.

The construction and arrangement of the structures and methods as shown in the various exemplary embodiments are illustrative only. Accordingly, all such modifications are intended to be included within the scope of the present disclosure. The order or sequence of any of the processed or method steps may be varied or re-sequenced according to alternative embodiments. Other substitutions, modifications, changes, and omissions may be made in the design, operating conditions and arrangements of the example embodiments without departing from the scope of the present disclosure.

What is claimed is:

1. A portable transportation vehicle, comprising:

a carrier having a first section and a second section;

a first pair of wheels, the first pair of wheels disposed below the first section of the carrier and including a first wheel and a second wheel and being fixed in a direction;

a first driving device for driving the first wheel of the first pair of wheels and a second driving device for driving the second wheel of the first pair of wheels;

a first swivel and a second swivel, each disposed below the second section of the carrier;

a second pair of wheels including a first wheel mounted on the first swivel and a second wheel mounted on the second swivel, and wherein the first pair of wheels and the second pair of wheels are arranged in parallel below the carrier, and wherein each of the first wheels are arranged in parallel to each of the second wheels;

an expander mounted on the carrier between the first swivel and the second swivel;

a linkage structure coupling the first swivel and the second swivel through the expander, the linkage structure providing tension for the first swivel and the second swivel; and a control device configured to transmit signals to the first driving device and the second driving device to drive the first pair of wheels, the second pair of wheels are being swiveled by the first swivel and the second swivel via the expander and the linkage structure in response to a difference between the rotational speeds of the first wheel and the second wheel of the first pair of wheels, wherein the first section of the carrier is foldable towards the second portion of the carrier.

2. The transportation vehicle of claim 1, further comprising a power device coupled to the first driving device and the second driving device.

3. The transportation vehicle of claim 1, wherein the first pair of wheels are arranged closer to a rear of the carrier than the second pair of wheels.

4. The transportation vehicle of claim 1, wherein each of the first driving device and the second driving device comprise a motor, wherein each of the motors is one of a brushless motor, a hob motor or an explicit motor.

5. The transportation vehicle of claim 1, wherein each of the first driving device and the second driving device comprises a reduction gear.

6. The transportation vehicle of claim 1, wherein the linkage structure comprises one of the following group consisting of: a shaft, an axle, a chain, or a belt.

7. The transportation vehicle of claim 1, wherein the first section and the second section are connected by a connecting structure.

8. The transportation vehicle of claim 7, wherein the connecting structure further comprises a locking mechanism to lock or unlock the first section and the second section in position.

9. The transportation vehicle of claim 1, further comprising at least one of a weight sensor, a pressure sensor and/or a global positioning system (GPS) device.

10. A portable transportation vehicle, comprising:

a carrier having a carrier part and a mechanical part;

the carrier having a first edge and a second edge;

the mechanical part comprising:

a pair of driving wheels arranged being proximal to the first edge, the pair of driving wheels including a first driving wheel and a second driving wheel, the first and second driving wheels being fixed in a direction;

a first swivel and a second swivel, the first swivel and the second swivel arranged being proximate to the second edge;

a pair of driven wheels, the pair of driven wheels including a first driven wheel coupled with the first swivel and a second driven wheel coupled with the second swivel, the pair of driven wheels being parallel to the pair of driving wheels, wherein the first driven wheel and the first driving wheel are arranged in parallel to the second driven wheel and the second driving wheel;

an expander mounted between the first swivel and the second swivel;

a linkage structure coupling the first swivel and the second swivel through the expander, the linkage structure providing tension for the first swivel and the second swivel;

a first driving device having a first motor for driving the first driving wheel;

a first controller connected to the first driving device for controlling the first driving device;

a second driving device having a second motor for driving the second driving wheel;

a second controller connected to the second driving device for controlling the second driving device;

a control device configured to communicate with the first controller and the second controller to control the first driving device and the second driving device; and a power device coupled to the first driving device and the second driving device;

wherein the transportation vehicle is foldable, and when folding the transportation vehicle, the pair of driving wheels and the pair of driven wheels move toward each other.

11. The transportation vehicle of claim 10, wherein the linkage structure comprises a shaft, an axle, a chain, or a belt.

12. The transportation vehicle of claim 10, wherein each of the first and second motors is one of a brushless motor, a hob motor or an explicit motor.

13. The transportation vehicle of claim 10, wherein each of the first driving device and the second driving device comprise a reduction gear.

14. The transportation vehicle of claim 10, wherein the carrier part comprises at least a first portion and a second portion, and the first portion and the second portion are connected by a connecting structure.

15. The transportation vehicle of claim 14, wherein the connecting structure further comprises a locking mechanism to lock or unlock the first portion and the second portion in position.

16. The transportation vehicle of claim 10, further comprising at least one of a weight sensor, a pressure sensor and/or a global positioning system (GPS) device.

* * * * *